US007325873B2

(12) United States Patent
Stewart et al.

(10) Patent No.: US 7,325,873 B2
(45) Date of Patent: Feb. 5, 2008

(54) SEATING UNIT

(75) Inventors: Robert Lawrence Stewart, Grapevine, TX (US); David J. Ritch, Venice, CA (US); Mark B. Saffell, Manhattan Beach, CA (US); Ari T. Adler, San Francisco, CA (US); Anthony Peter Patron, Mountain View, CA (US); Matthew David Inouye, Foster City, CA (US); Alan Chung Regala, Mountain View, CA (US); Jonathan I. Kaplan, Palo Alto, CA (US); James Yurchenco, Palo Alto, CA (US)

(73) Assignee: Steelcase Inc., Grand Rapids, MI (US)

( * ) Notice: Subject to any disclaimer, the term of this patent is extended or adjusted under 35 U.S.C. 154(b) by 100 days.

(21) Appl. No.: 11/151,063

(22) Filed: Jun. 13, 2005

(65) Prior Publication Data

US 2006/0103206 A1 May 18, 2006

Related U.S. Application Data

(60) Provisional application No. 60/579,107, filed on Jun. 12, 2004.

(51) Int. Cl.

| | |
|---|---|
| ***A47C 1/024*** | (2006.01) |
| ***A47C 1/038*** | (2006.01) |
| ***A47C 3/026*** | (2006.01) |
| ***A47C 3/04*** | (2006.01) |
| ***A47C 3/12*** | (2006.01) |

(52) U.S. Cl. ..... 297/301.3; 297/300.1; 297/300.4; 297/300.6; 297/300.8; 297/239

(58) Field of Classification Search ..... 297/300.4, 297/300.6, 300.7, 300.8, 301.3, 301.5, 301.6, 297/301.7, 303.1, 303.3, 239
See application file for complete search history.

(56) References Cited

U.S. PATENT DOCUMENTS

| | | | | |
|---|---|---|---|---|
| 3,690,726 | A | 9/1972 | Van Ryn | |
| 4,332,418 | A | 6/1982 | Strowik | |
| 4,732,424 | A * | 3/1988 | Uredat-Neuhoff | 297/300.4 X |
| 4,874,205 | A | 10/1989 | Arefinejad et al. | |
| 5,209,548 | A * | 5/1993 | Locher | 297/300.4 |
| 5,288,130 | A * | 2/1994 | Foster | 297/301.6 X |
| 5,393,120 | A | 2/1995 | Woods et al. | |
| 5,547,254 | A | 8/1996 | Hoshihara | |
| 5,601,335 | A | 2/1997 | Woods et al. | |
| 5,975,634 | A * | 11/1999 | Knoblock et al. | 297/300.4 |
| 6,030,037 | A * | 2/2000 | Ritch et al. | 297/239 |
| 6,086,153 | A * | 7/2000 | Heidmann et al. | 297/300.1 |
| 6,142,566 | A * | 11/2000 | Ritch et al. | 297/239 |
| 6,286,901 | B1 * | 9/2001 | Ritch et al. | 297/239 X |
| 6,382,719 | B1 * | 5/2002 | Heidmann et al. | 297/300.4 X |
| 6,394,548 | B1 * | 5/2002 | Battey et al. | 297/300.6 X |

(Continued)

*Primary Examiner*—Rodney B. White
(74) *Attorney, Agent, or Firm*—Price, Heneveld, Cooper, DeWitt & Litton, LLP

(57) ABSTRACT

A seating unit comprising a base configured to be positioned on a floor, a torsional energy unit connected to the base, a back connected to the torsional energy unit and a seat rotatably connected to the torsional energy unit. The torsional energy unit biases the back to a forward position. The torsional energy unit further limits angular rotation of the seat between a substantially horizontal seating position and a substantially vertical seating position.

19 Claims, 15 Drawing Sheets

U.S. PATENT DOCUMENTS 6,394,549 B1 * 5/2002 DeKraker et al. ... 297/300.6 X
6,460,928 B2 * 10/2002 Knoblock et al. ... 297/303.1 X
6,523,900 B1 2/2003 Conner et al.
6,536,841 B1 * 3/2003 Pearce et al. ..... 297/300.4 X
6,631,954 B2 10/2003 Amorin et al.
6,652,030 B2 11/2003 Conner et al.
6,679,553 B2 * 1/2004 Battey et al. ..... 297/300.4
6,817,668 B2 * 11/2004 DeKraker et al. ..... 297/300.8
2003/0062754 A1 4/2003 Yamada
2004/0075325 A1 4/2004 Assmann et al.

* cited by examiner

SEATING UNIT

CROSS REFERENCE TO RELATED APPLICATION

This application claims priority to U.S. Provisional Patent Application No. 60/579,107, entitled SEATING UNIT, which was filed on Jun. 12, 2004, the entire disclosure of which is incorporated herein by reference.

FIELD OF THE INVENTION

The present invention concerns a seating unit.

BACKGROUND OF THE INVENTION

Modern chairs often have backs and seats that move upon recline of a person seated in the chairs. More sophisticated chairs include motion control mechanisms to provide sliding and pivoting motions that move in a particular way relative to the seated user so as to provide an optimally comfortable and adjustable chair motion. However, these mechanisms tend to be sophisticated with rigid pivot end slide elements which can result in complex control mechanisms that have many pieces and are difficult to assemble. In turn, the chair becomes expensive. Further, the mechanisms take up space and can become structurally large in size, which is unacceptable for chairs requiring a thin profile or otherwise requiring a clean unobstructed area under their seat. Also, design of these mechanisms is a complex task, with substantial time required to understand and work out competing functional requirements and physical relationships.

Accordingly, a seating unit with motion control mechanism is desired having the aforementioned advantages and solving the aforementioned problems, including having a relatively small, compact mechanism that is flexible and adaptable for different circumstances, and yet that provides a comfortable motion. Also, a motion control mechanism is desired that is easier to incorporate into chair designs without substantial design time, prototyping, and testing. Moreover, a seating unit that is easy to stack or nestle with another similar seating unit is desired.

SUMMARY OF THE INVENTION

An aspect of the present invention is to provide a seating unit comprising a base configured to be positioned on a floor, a torsional energy unit connected to the base, a back connected to the torsional energy unit and a seat rotatably connected to the torsional energy unit. The torsional energy unit biases the back to a forward position. The torsional energy unit further limits angular rotation of the seat between a substantially horizontal seating position and a substantially vertical seating position.

Another aspect of the present invention is to provide a seating unit comprising a base configured to be positioned on a floor, a pair of connection devices connected to the base, a back connected to the connection devices and a seat rotatably connected to the connection devices. The connection devices bias the back to a forward position. The connection devices further limit angular rotation of the seat between a substantially horizontal seating position and a substantially vertical seating position. Each connection device allows sides of the back to rotate independently, thereby allowing a first side or a second side of the back to be rotated rearward relative to the other side of the back. The base includes a front area and a rear area, with the front area having a different configuration than the rear area such that a pair of the seating units can be positioned next to each other when the seat is in the vertical stacking position. The seat of a rear one of the seating units abuts the back of a second one of the seating units.

Yet another aspect of the present invention is to provide a torsional energy unit for a seating unit having a base, a seat and a back. The torsional energy unit comprises a base member configured to the base of the seating unit, with the base including at least one arcuate slot and a notch. The torsional energy unit also includes a torsional spring engaged with the base member and having an end and a pin engaged with the end of the torsional spring and located within the notch of the base member, thereby limiting movement of the end of the torsional spring. The torsional energy unit further includes a rotating member rotatably connected to the base member and connected to the pin, with the rotating member being configured to be connected to the back of the seating unit. The torsional spring biases the rotating member such that the pin will abut a first end of the notch and bias the back to a forward position when the rotating member is connected to the back. The pin abuts a second end of the notch when the rotating member is connected to the back and the back is forced rearward against the bias of the torsional spring to prevent further rearward movement of the back. The at least one arcuate slot is configured to accept a flange of the seat of the seating unit therein for limiting movement of the seat.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
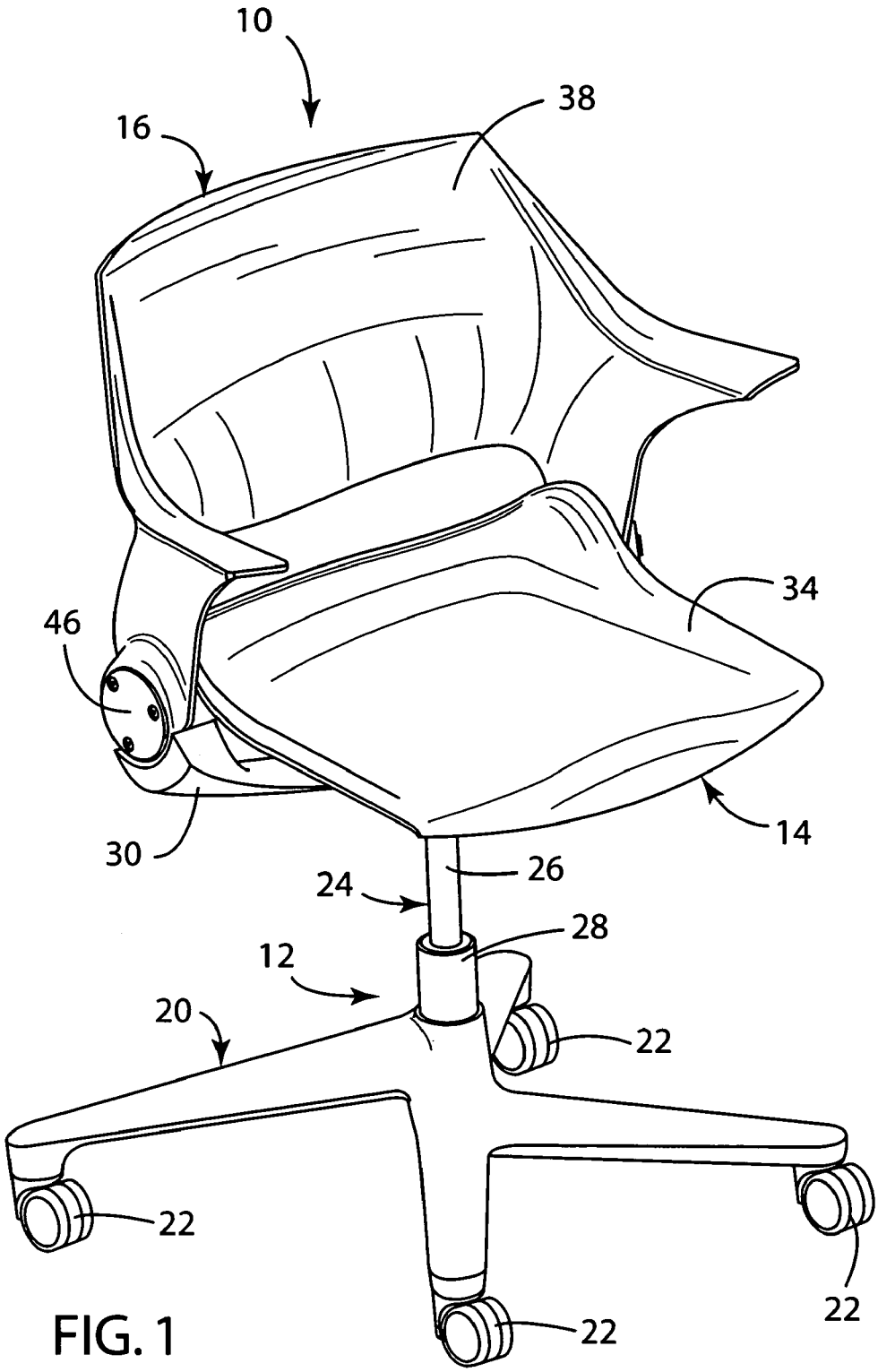
FIG. 1 is a perspective view of a seating unit of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1-3) generally designates a seating unit of the present invention. The seating unit 10 includes a base 12, a seat 14 and a back 16. The seat 14 and the back 16 are connected to the base 12 by a connection device 18 (see FIG. 6).

Figure 2:
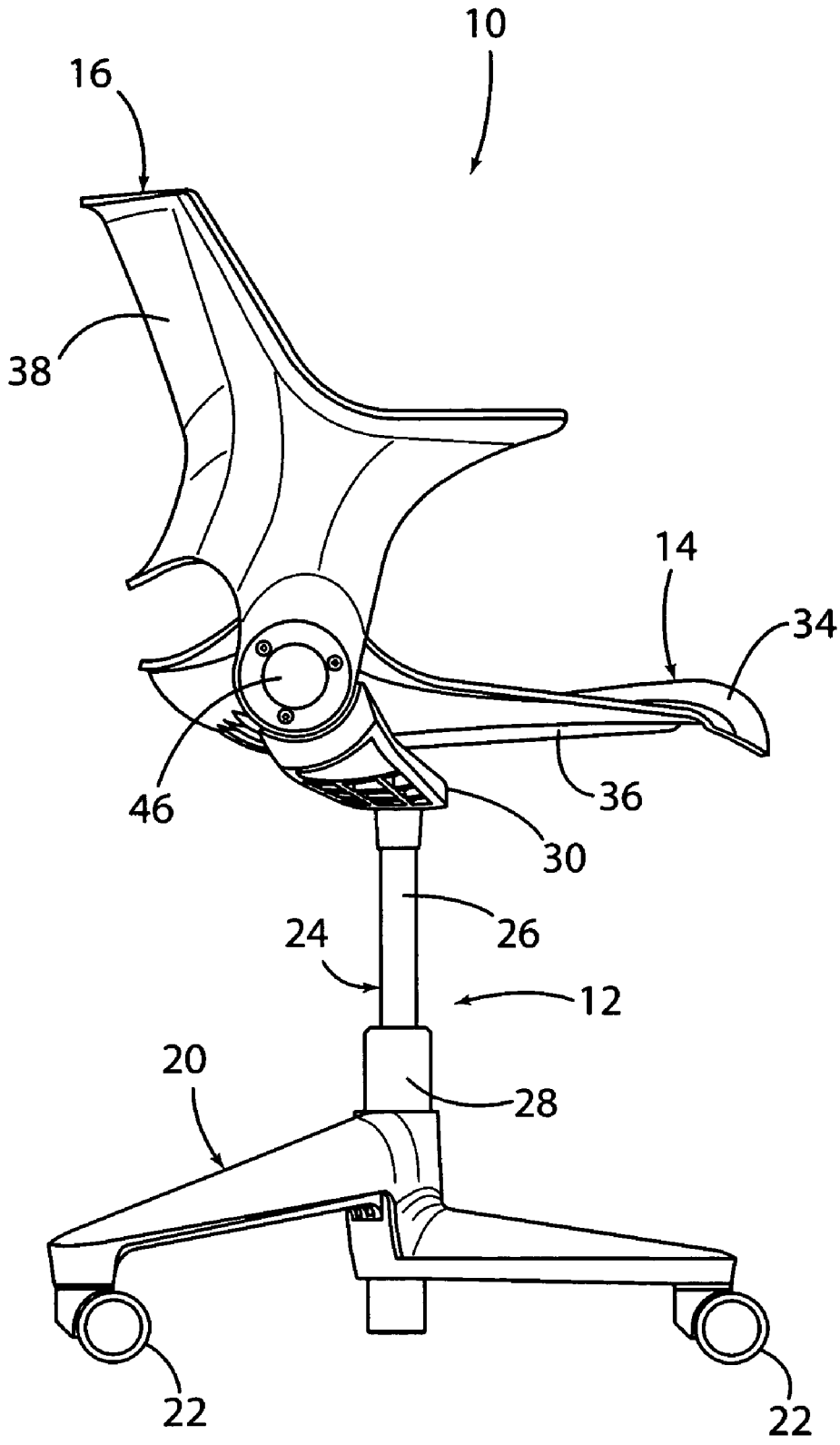
FIG. 2 is a side view of the seating unit of the present invention.

In the illustrated example, the base 12 (FIGS. 1-4) includes a bottom X-shaped support 20 having casters 22 at ends of the bottom X-shaped support 20 for movably supporting the base 12 on a floor. A vertically extending support 24 extends upwardly from the bottom X-shaped support 20. It is contemplated that the vertically extending support 24 can have a first telescoping section 26 and a second telescoping section 28 as is well known to those skilled in the art, thereby allowing the vertically extending support 24 to be selectively and vertically adjustable. A yoke 30 is connected to the top of the vertically extending support 24. The yoke 30 includes a pair of end receiving sections 32 (see FIG. 4) configured to be connected to the connecting device 18. As illustrated in FIG. 2, a front portion of the bottom X-shaped support 20 is lower than a rear portion of the bottom X-shaped support 20, thereby allowing the front portion of the bottom X-shaped support 20 of a first rear seating unit 10 to slide under the rear portion of the bottom X-shaped support 20 of a second front seating unit 10. It is contemplated that the base 12 could comprise a pair of inverted V-shaped support legs having casters on a lower end thereof and a yoke extending between the top of the inverted V-shaped support legs. Furthermore, it is contemplated that any base having the receiving sections 32 could be used.

Figure 3:
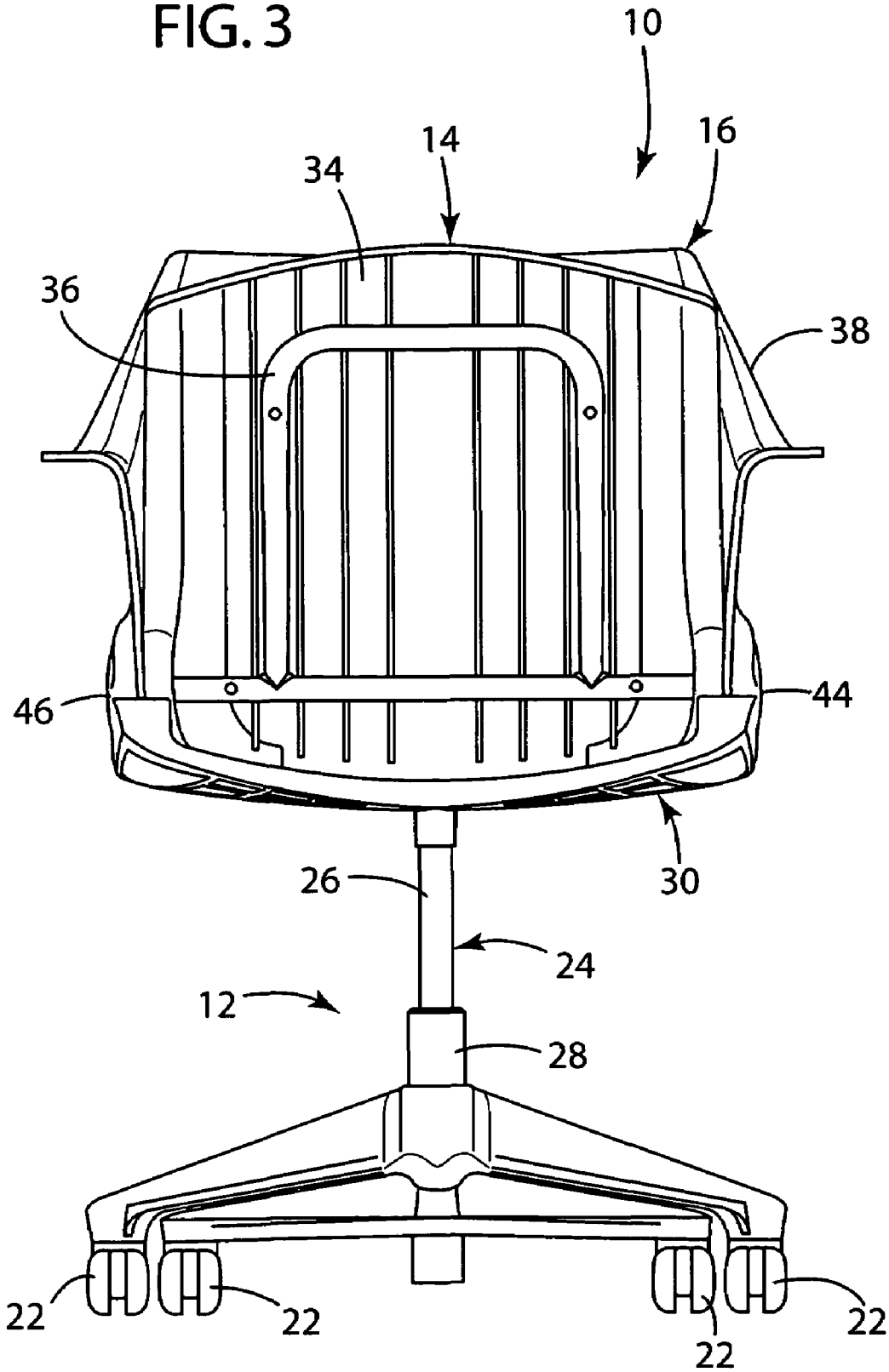
FIG. 3 is a front side view of the seating unit of the present invention with a seat in a vertical position.
Figure 4:
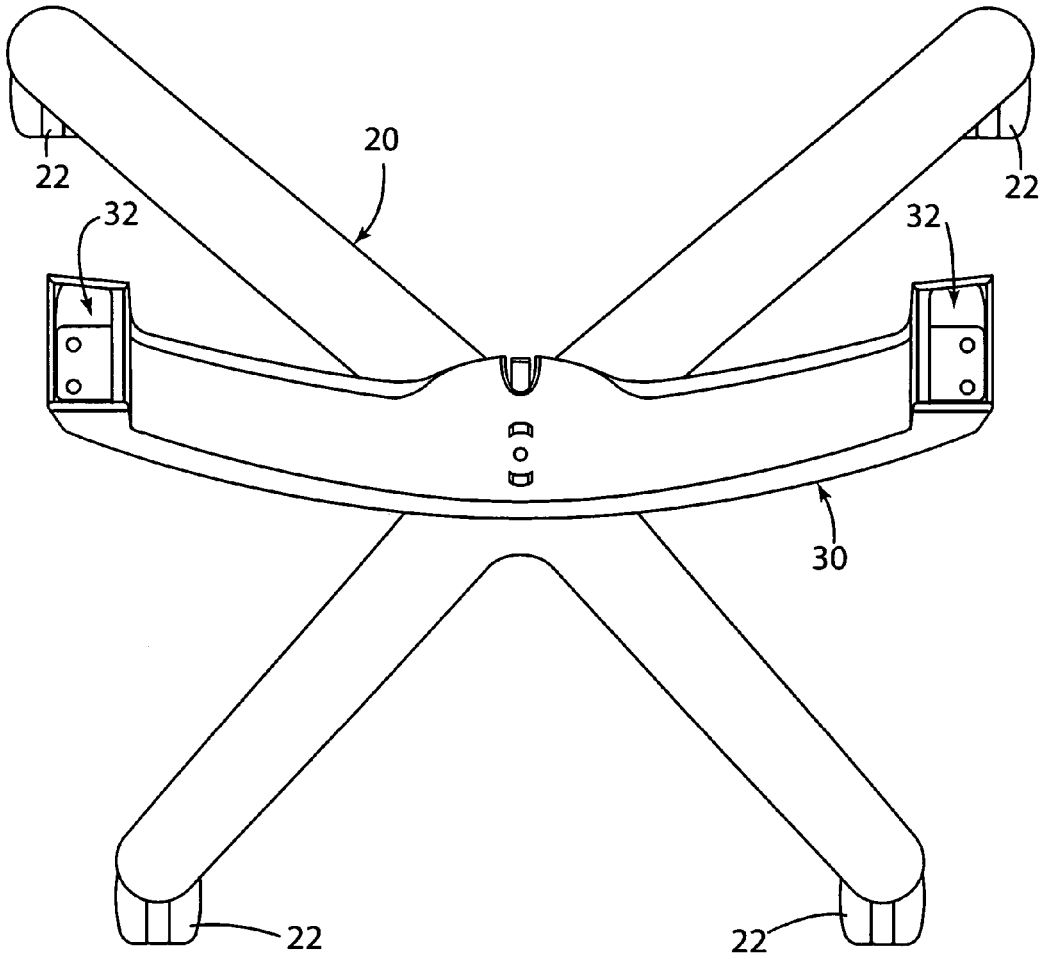
FIG. 4 is a top view of a base and a yoke of the seating unit of the present invention.

The illustrated seat 14 includes a seat tray 34 and a seat support frame 36. The seat support frame 36 is connected to the seat tray 34 and supports the seat tray 34. As discussed in more detail below, the seat support frame 36 is connected to the connection device 18, which allows the seat tray 34 to rotate between a horizontal seating position (FIGS. 1 and 2) and a vertical stacking position (FIG. 3).

In the illustrated example, the back 16 includes a seat back 38 (FIG. 4), a right inside connection device cover 40, a left inside connection device cover 42, a right outside cover 44 and a left outside cover 46. As discussed in more detail below, the seat back 38 is connected to the connection device 18, which biases the seat back 38 forward.

The illustrated connection device 18 (FIG. 6) rotatably supports the seat 14 for rotation between the horizontal seating position and the vertical stacking position and supports the back 16. The connection device 18 includes an L-shaped base plate 50 (see FIG. 7) connected to at least one of the end receiving sections 32. The L-shaped base plate 50 includes a base portion 52 having a pair of fastener holes 54 therein for being connected to the end receiving section 32 of the yoke 30 with fasteners. The L-shaped base plate 50 also includes an upwardly extending support portion 56. Preferably, the upwardly extending support portion 56 of two L-shaped base plates 50 connected to the yoke 30 are parallel. The upwardly extending support portion 56 of the L-shaped base plate 50 includes a pair of arcuate slots 58, a top notch 60 and a center opening 62. The L-shaped base plates 50 are connected to the yoke 30 such that the upwardly extending support portions 56 are facing inward.

Figure 8:
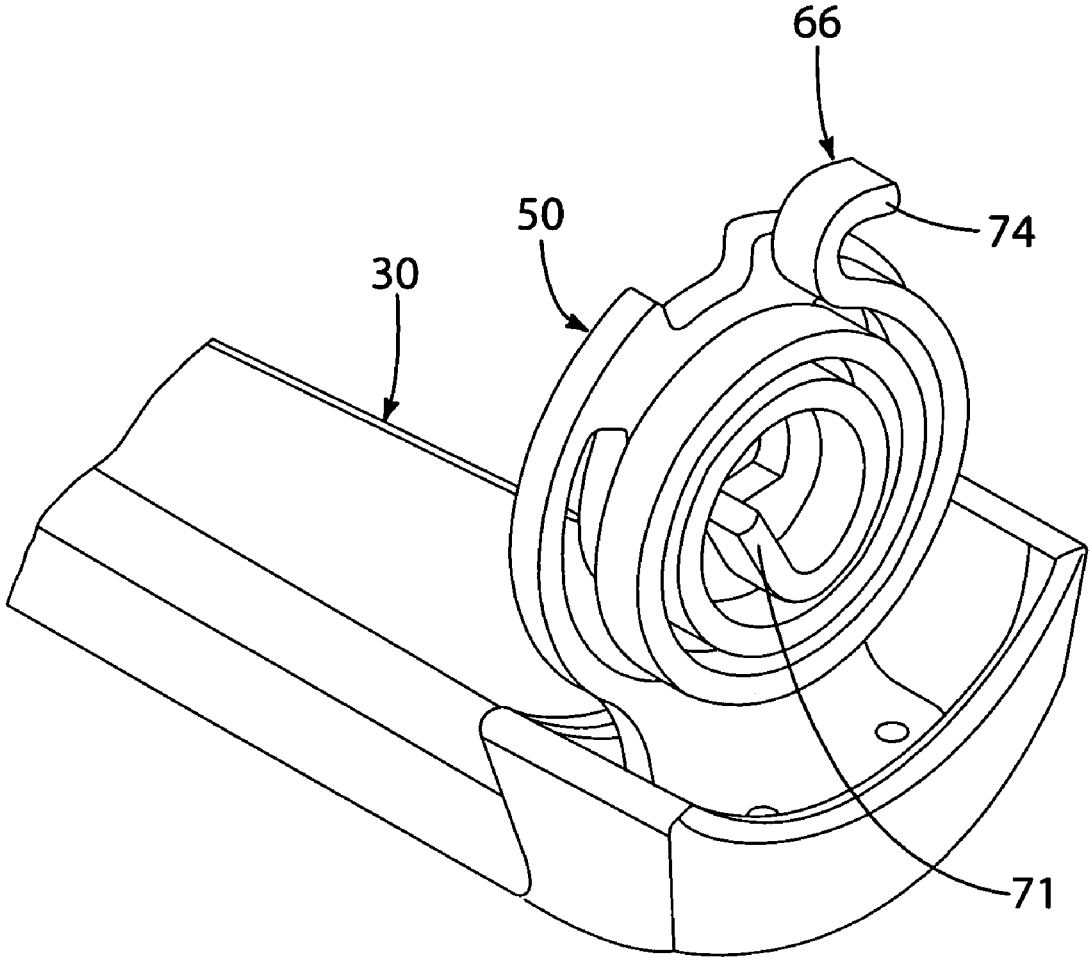
FIG. 8 is a partial perspective view of the yoke and a second assembly step of the connection device of the seating unit of the present invention.
Figure 9:
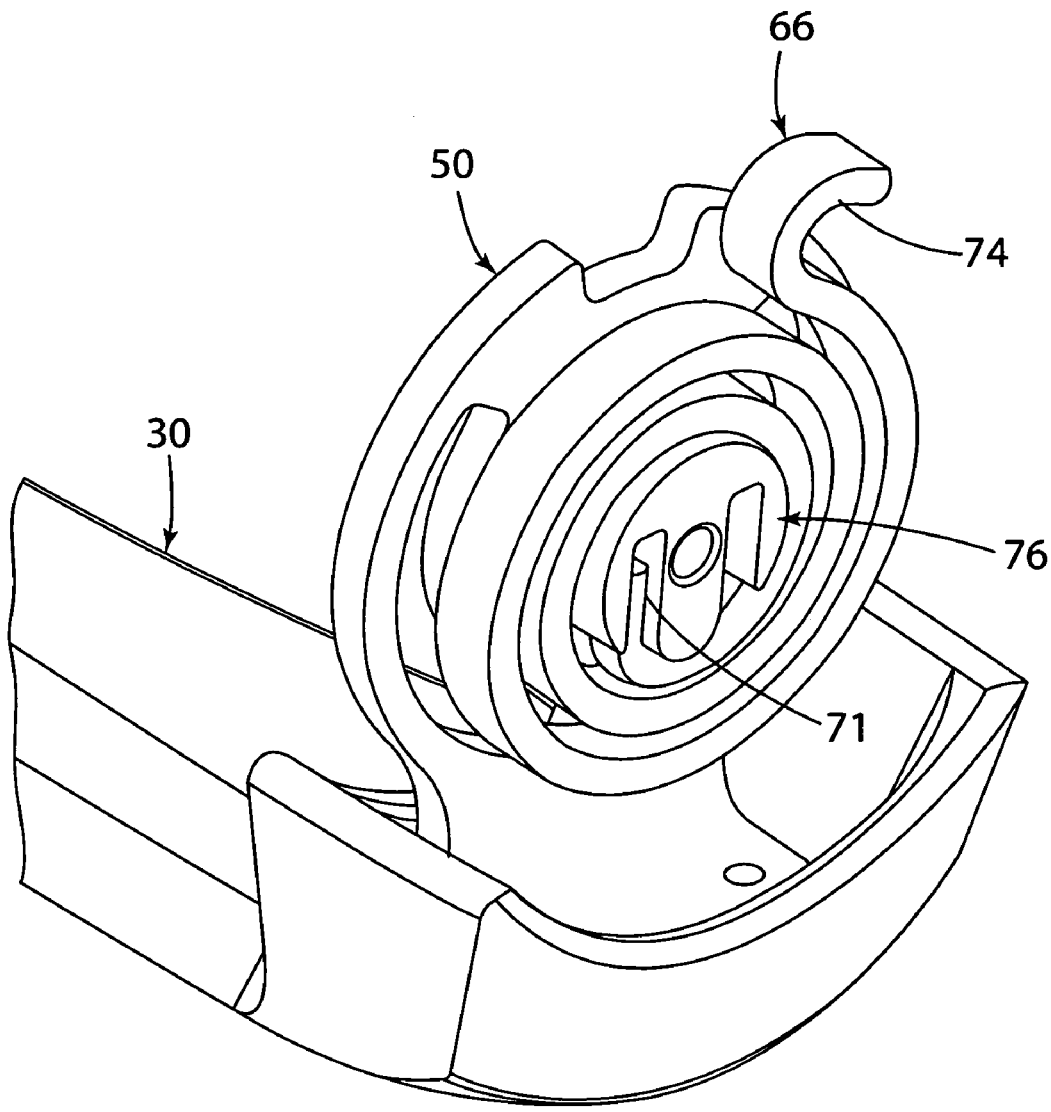
FIG. 9 is a partial perspective view of the yoke and a third assembly step of the connection device of the seating unit of the present invention.

In the illustrated example, the connection device 18 includes an energizer plate 64 (see FIGS. 6 and 10) connected to the L-shaped base plate 50 and biased relative thereto by a torsion spring 66. The energizer plate 64 is U-shaped and includes a leg portion 68, an annular back connection portion 70 and a spanning portion 72 connecting the leg portion 68 and the annular back connection portion 70. The torsion spring 66 is shaped in a spiral and includes an inner end 71 and an outer hook end 74. Although the torsion spring 66 is illustrated as being a single flat piece of metal or other resilient material shaped into a spiral, it is contemplated that the torsion spring 66 could comprise a plurality of pieces of material shaped into a spiral. The connection device 18 can be constructed by placing the torsion spring 66 adjacent an outside face of the upwardly extending support portion 56 of the L-shaped base plate 50 such that the outer hook end 74 of the torsion spring 66 is generally aligned with the top notch 60 in the upwardly extending support portion 56 of the L-shaped base plate 50 (see FIGS. 8 and 9). Thereafter, a spring anchor 76 is placed into the center of the torsion spring 66, capturing the inner end 71 of the torsion spring 66 and preventing the torsion spring 66 from rotating as discussed below (see FIG. 9).

Figure 10:
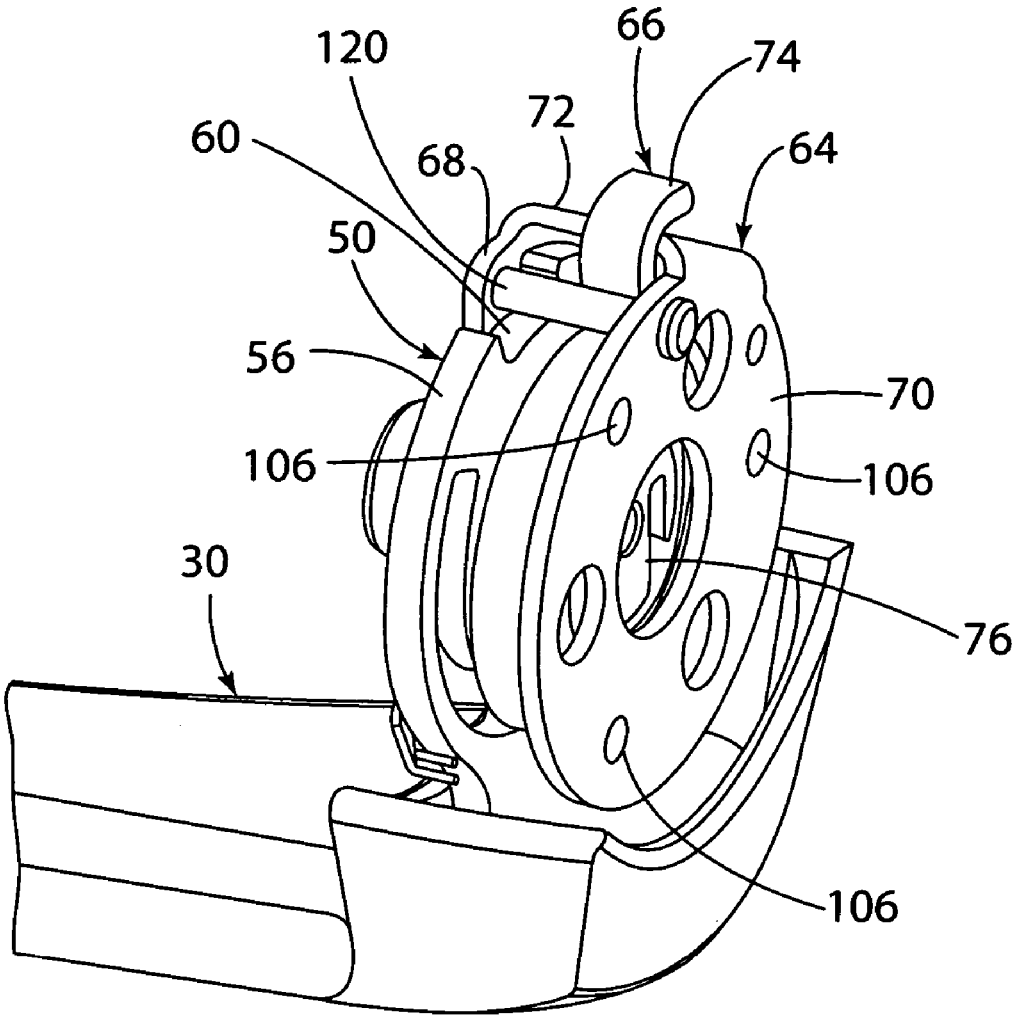
FIG. 10 is a partial perspective view of the yoke and fourth assembly step of the connection device of the seating unit of the present invention.

The illustrated energizer plate 64 is placed into the connection device 18 with the spanning portion 72 being located within the outer hook end 74 of the torsion spring 66, the leg portion 68 being located adjacent the inner side of the upwardly extending support portion 56 of the L-shaped base plate 50 and the annular back connection portion 70 being located adjacent the torsion spring 66 (see FIG. 10). Furthermore, a washer 78 is preferably located between the leg portion 68 of the energizer plate 64 and the inner side of the upwardly extending support portion 56 of the L-shaped base plate 50 (see FIG. 6).

Figure 6:
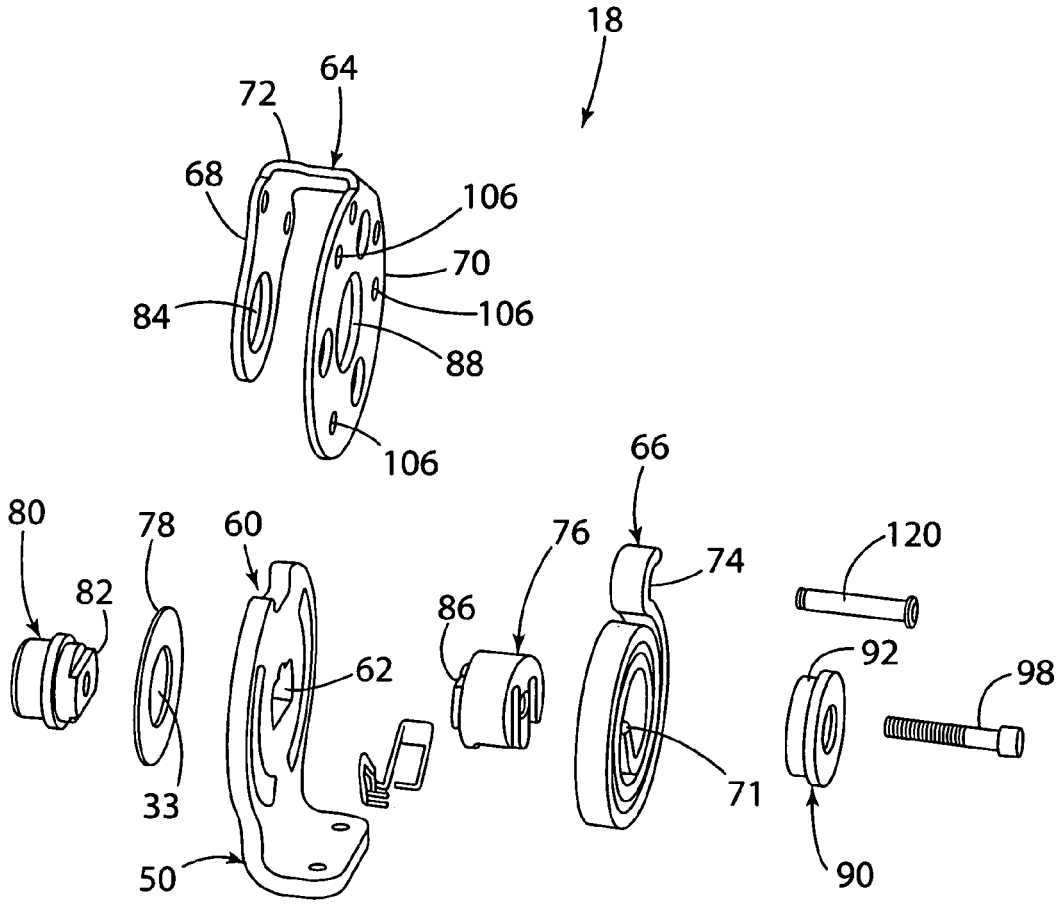
FIG. 6 is an exploded view of a connection device of the seating unit of the present invention.
Figure 7:
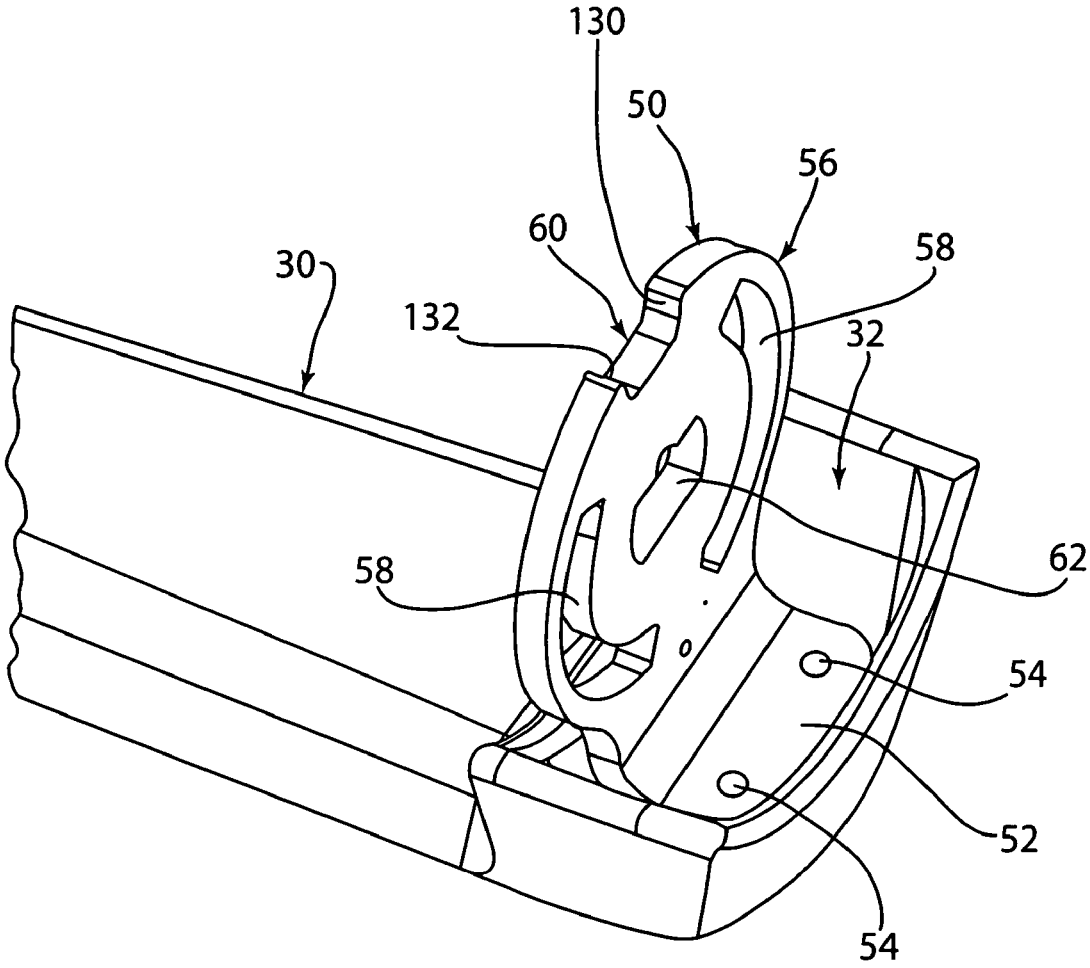
FIG. 7 is a partial perspective view of the yoke and a first assembly step of the connection device of the seating unit of the present invention.
Figure 11:
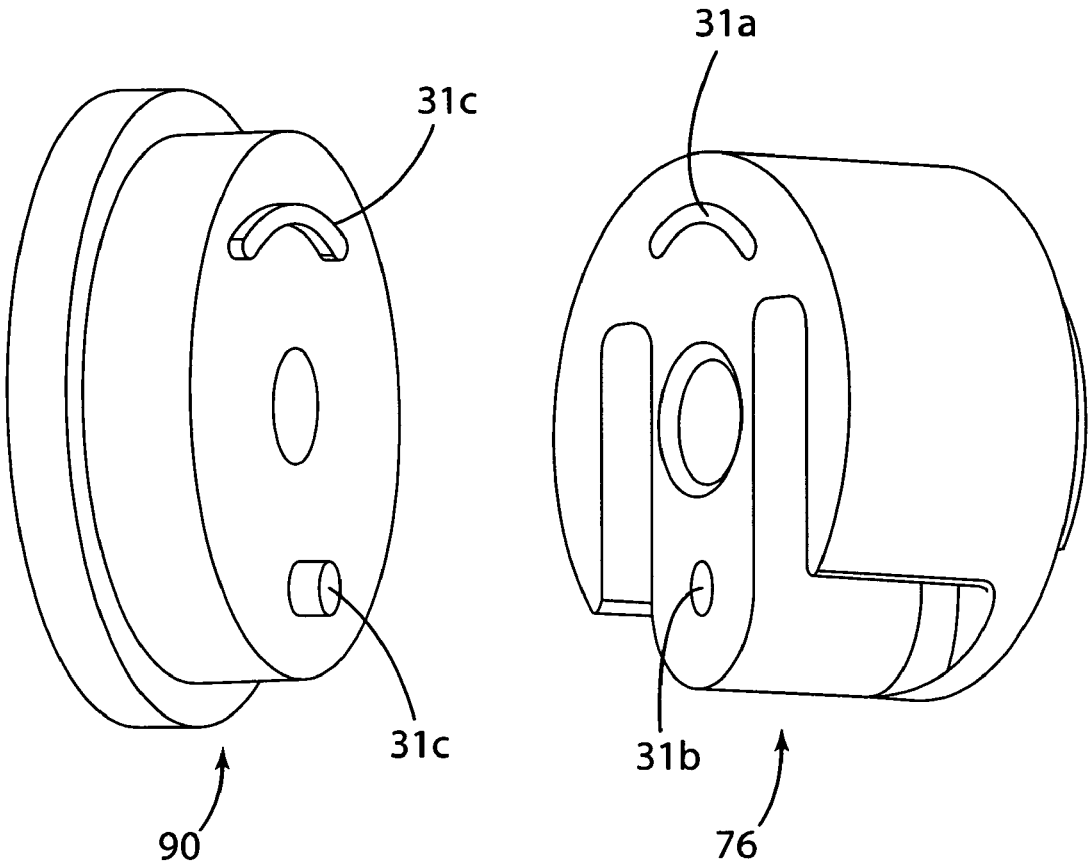
FIG. 11 is an exploded perspective view of the parts of the connection device of the seating unit of the present invention.

In the illustrated example, the L-shaped base plate 50, the torsion spring 66 and the energizer plate 64 are connected by inserting an inside axle 80 having a rectangular inner end 82 through an annular opening 84 in the leg portion 68 of the energizer plate 64, through an annular opening 33 in the washer 78, and through the center opening 62 in the upwardly extending support portion 56 of the L-shaped base plate 50 (which is also shown as being rectangular) (see FIG. 6). The spring anchor 76 also preferably includes a rectangular boss 86 that is inserted into the center opening 62 in the upwardly extending support portion 56 of the L-shaped base plate 50, thereby preventing the spring anchor 76 and the inner end 71 of the torsion spring from rotating. A spring anchor tandem member 90 includes a cylindrical portion 92 that extends through a center opening 88 in the annular back connection portion 70 of the energizer plate 64 and abuts against the spring anchor 76. It is contemplated that the spring anchor 76 and the spring anchor tandem member 90 could having mating projections (such as the slot 31*a* and opening 31*b* with mating extending members 31*c* shown in FIG. 11) to rotatably lock the spring anchor tandem member 90 with the spring anchor 76. Finally, a pin 98 is inserted through center openings in the spring anchor tandem member 90, the spring anchor 76 and therefore the center of the spring 66, the center opening 62 in the upwardly extending support portion 56 of the L-shaped base plate 50, the washer 78 and into the inside axle 80 to connect the above elements together.

The illustrated spring 66 biases the back 16 in an upright position. As illustrated in the figures, the outer hook end 74 of the spring 66 captures the spanning portion 72 of the energizer plate 64 therein. The spring 66 therefore biases the spanning portion 72 towards the front of the seating unit 10. In other words, the right side spring 66 biases the energizer plate 64 in a clockwise direction and the left side spring 66 biases the energizer plate 64 in a counterclockwise direction (as the left side connection device 18 is a mirror image of the left side connection device 18). Furthermore, the energizer plate 64 is configured to rotate on circular surfaces of the spring anchor tandem member 90 (the outside surface of the cylindrical portion 92) and the inside axle 80. The annular back connection portion 70 of the energizer plate 64 is connected to the back 16.

Figure 5:
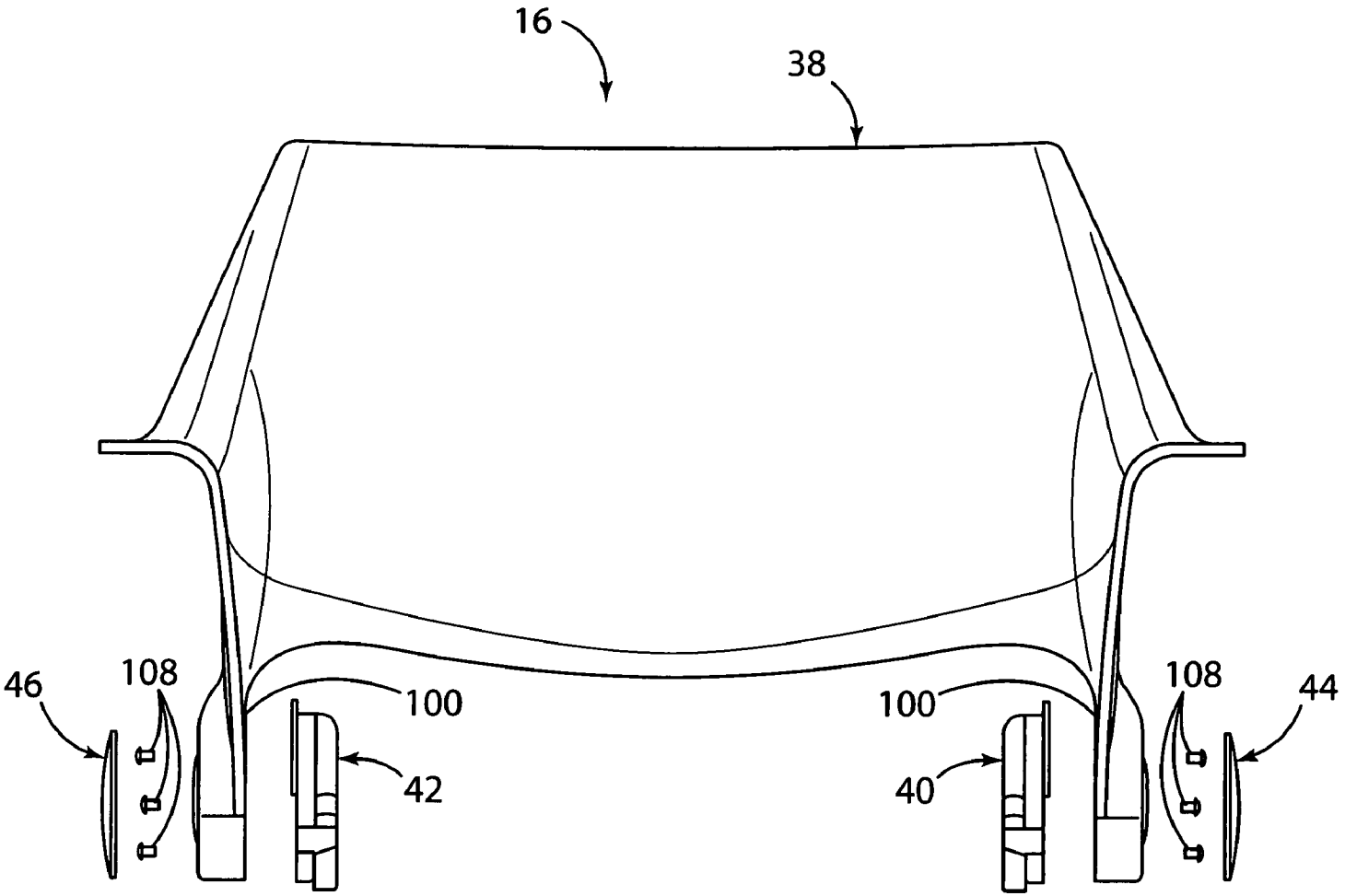
FIG. 5 is an exploded front view of a seat of the seating unit of the present invention.
Figure 12:
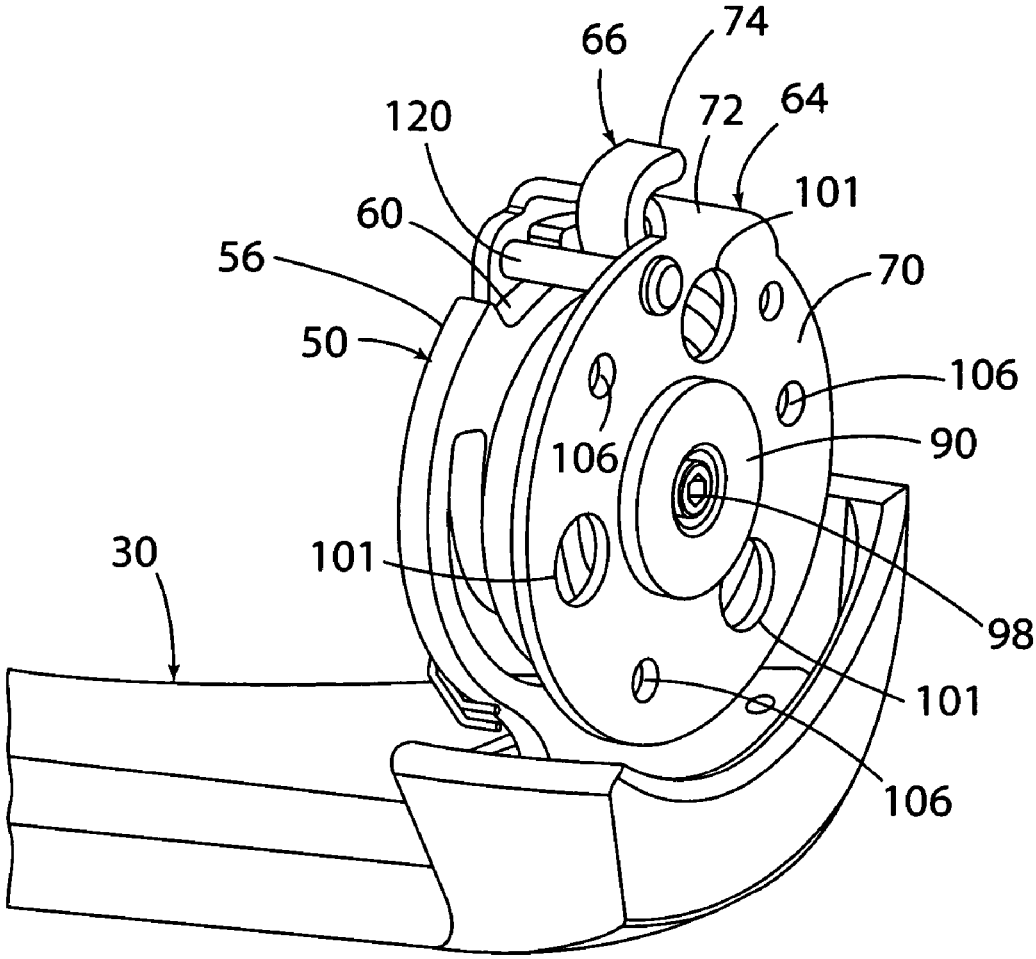
FIG. 12 is a first side partial perspective view of the yoke and fifth assembly step of the connection device of the seating unit of the present invention.
Figure 13:
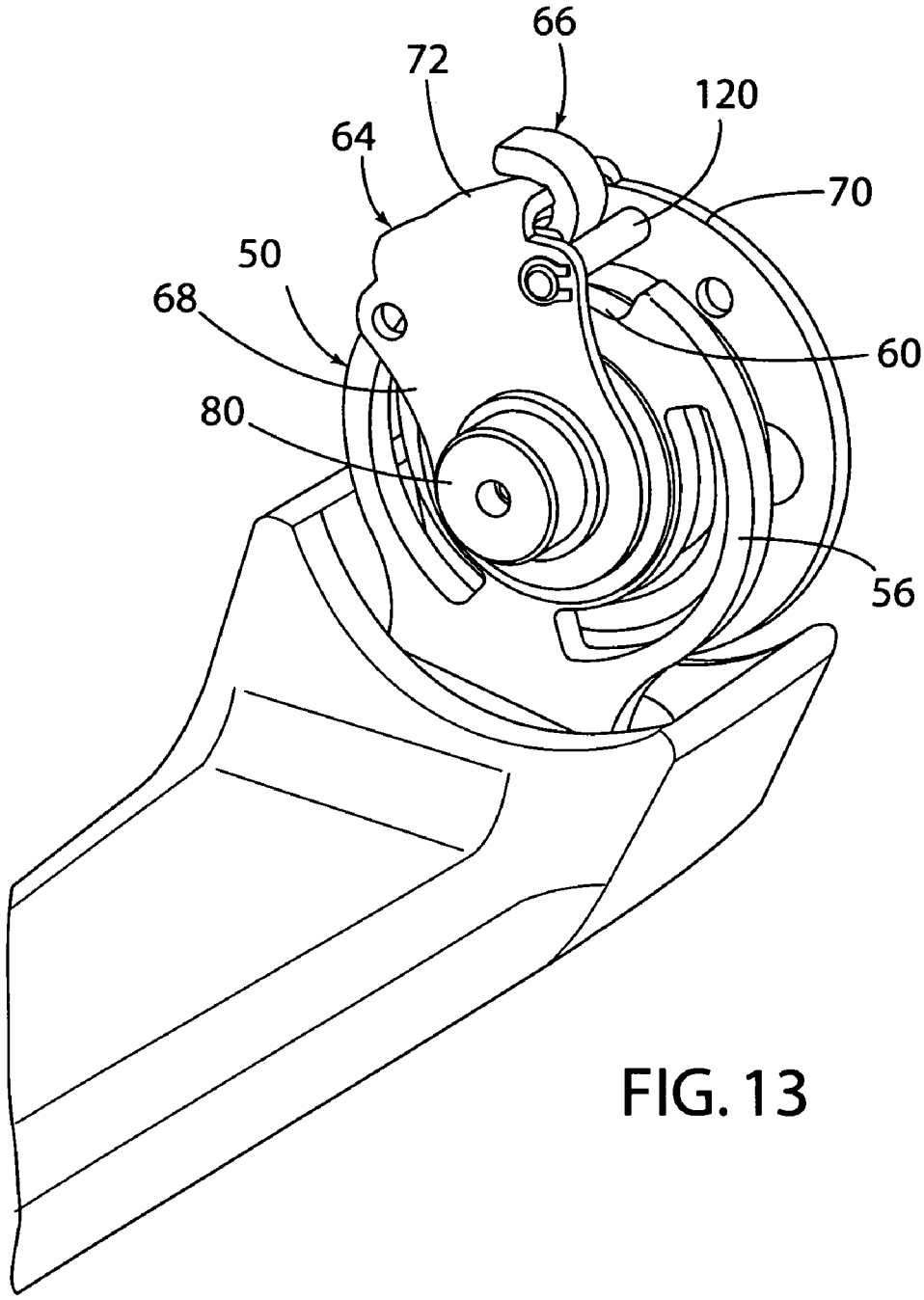
FIG. 13 is a second side partial perspective view of the yoke and fifth assembly step of the connection device of the seating unit of the present invention.
Figure 14:
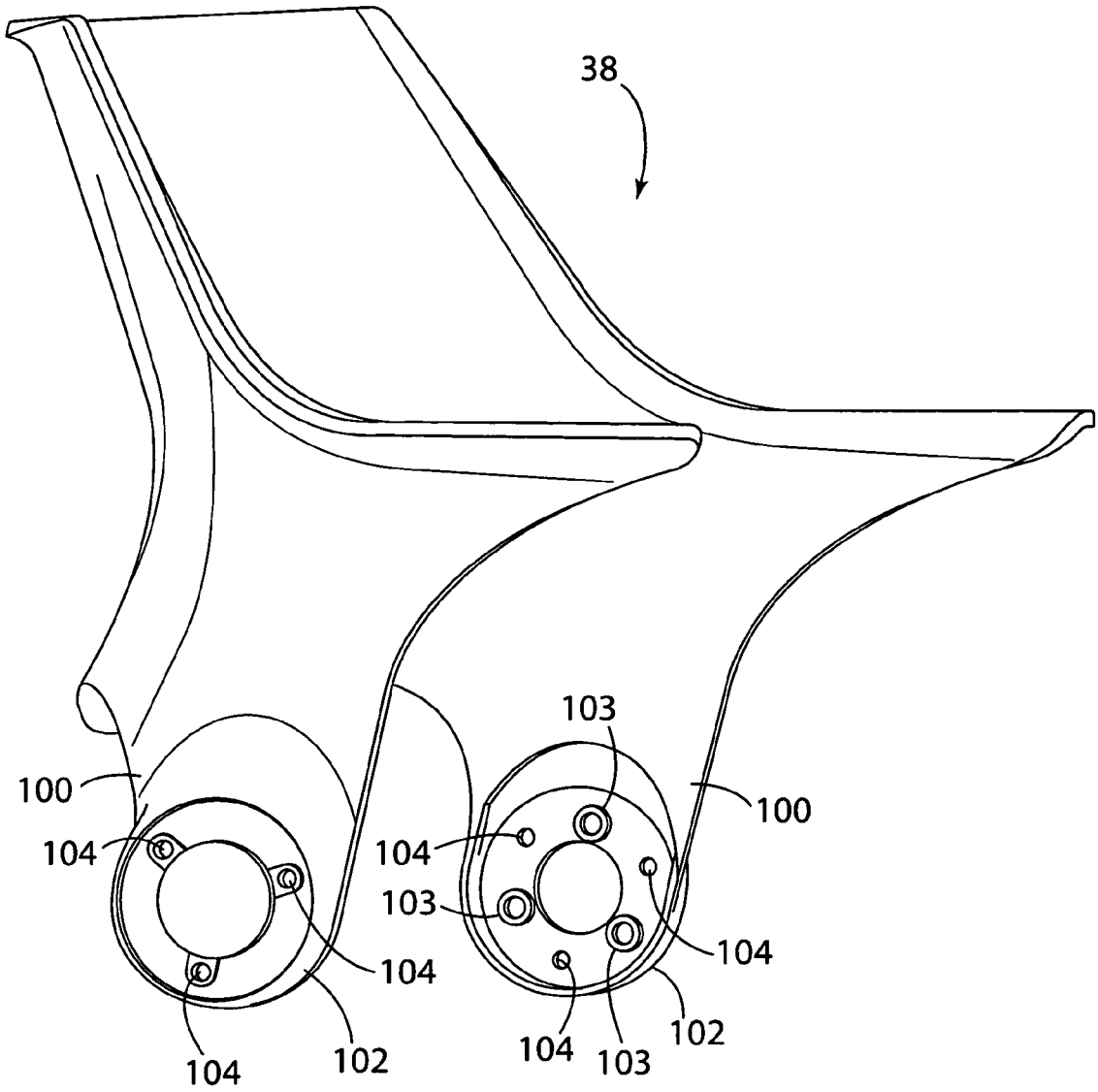
FIG. 14 is a perspective view of the seat of the seating unit of the present invention.
Figure 15:
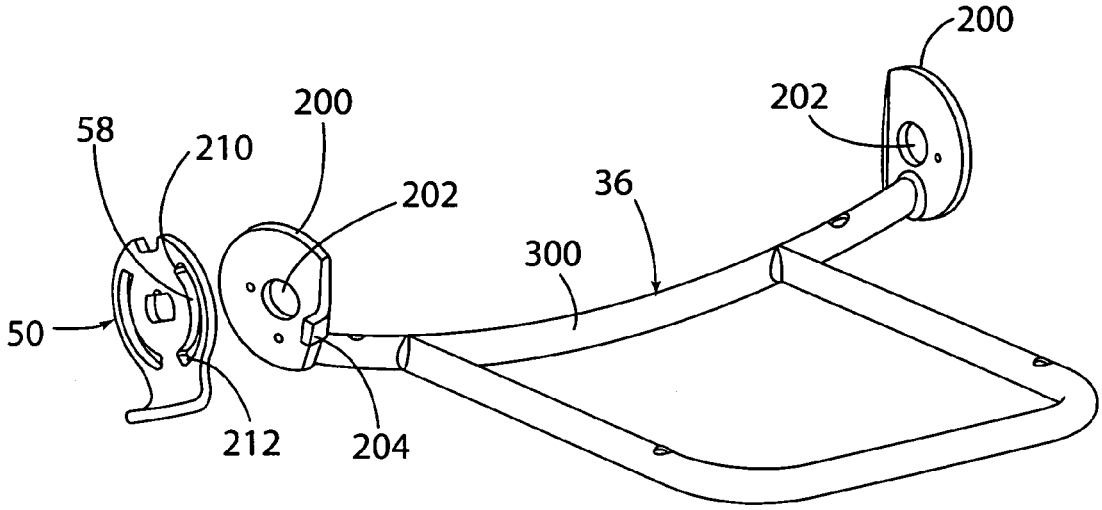
FIG. 15 is an exploded perspective view of a seat support and a base plate of the connection device of the seating unit of the present invention.

In the illustrated example, the seat back 38 of the back 16 includes bottom legs 100 having circular ends 102 (see FIG. 14). The circular ends 102 have a plurality of holes 104 therein. As illustrated in FIGS. 6, 10 and 12, the annular back connection portion 70 of the energizer plate 64 also has holes 106 therein. The seat back 38 is connected to the connection device 18 by placing the circular ends 102 of the seat back 38 over an outside of the annular back connection portion 70 of the energizer plate 64 and aligning the holes 104 in the circular ends 102 of the seat back 38 with the holes 106 in the annular back connection portion 70 of the energizer plate 64. Fasteners 108 (see FIG. 5) are then inserted through the holes 104 and 106 to connect the circular ends 102 of the seat back 38 to the annular back connection portion 70 of the energizer plate 64. Accordingly, the seat back 38 with be connected to the energizer plate 64 and rotate therewith. Therefore, the spring 66 will bias the seat back 38 in an upright position. In the illustrated embodiment, the right outside cover 44 and the left outside cover 46 are placed over the circular ends 102 of the seat back 38 after the fasteners 108 have been connected thereto.

The illustrated connection device 18 includes a seat back limiting device for limiting rotation of the seat back 38. The connection device 18 includes a limiting pin 120 inserted through aligned openings in the leg portion 68 and the annular back connection portion 70 of the energizer plate 64. The limiting pin 120 is also located in the top notch 60 of the upwardly extending support portion 56 of the L-shaped base plate 50. The top notch 60 includes a first end 130 and a second end 132 (see FIG. 7). The limiting pin 120 is configured to slide within the top notch 60 between the first end 130 and the second end 132. As the energizer plate 64 rotates the seat back 38 forward under the bias of the spring 66, the limiting pin 120 will abut against the first end 130 of the top notch 60, thereby preventing the seat back 38 from rotating any more forward. Similarly, as a person sits in the seating unit 10 and rotates the seat back 38 backwards against the bias of the spring 66, the limiting pin 120 will eventually abut against the second end 132 of the top notch 60, thereby stopping rotation of the seat back 38 rearward.

In the illustrated example, the seat support frame 36 includes a pivot rod 300 having a pair of circular plates 200 on ends thereof. The circular plates 200 include a central opening 202 and an arcuate flange 204 extending outwardly. The seat support frame 36 is connected to the connection device 18 by inserting the inside axle 80 into the central opening 202 of the circular plates 200 of the seat support frame 36, thereby allowing the seat support frame 36 to rotate about the inside axle 80. In the illustrated embodiment, the arcuate flanges 204 of the circular plates 200 of the seat support frame 36 are inserted into one of the arcuate slots 58 in the upwardly extending support portion 56 of the L-shaped base plate 50. The upwardly extending support portion 56 of the L-shaped base plate 50 preferably includes a pair of arcuate slots 58 such that only one configuration of the L-shaped base plate 50 can be used as mirror images in each side of the yoke 30, with a pair of arcuate slots 58 being aligned. The arcuate flanges 204 are allowed to slide within the arcuate slots 58 of the extending support portion 56 of the L-shaped base plate 50 between a top end 210 and a bottom end 212 of the arcuate slots 58. When the arcuate flanges 204 abut the top end 210 of the arcuate slots 58, the seat support frame 36 is in the vertical stacking position. Moreover, when the arcuate flanges 204 abut the bottom end 212 of the arcuate slots 58, the seat support frame 36 is in the horizontal seating position. The illustrated pivot rod 300 is not aligned with an axis of rotation of the seat support frame 36. Furthermore, the left side of the seat back 38 and the right side of the seat back 38 can independently rotate, thereby allowing the left side or right side of the seat back 38 to be rotated backward relative to the other side of the seat back 38.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A seating unit comprising:

a base configured to be positioned on a floor;

a torsional energy unit connected to the base;

a back connected to the torsional energy unit; and a seat rotatably connected to the torsional energy unit;

the torsional energy unit biasing the back to a forward position; and the torsional energy unit limiting angular rotation of the seat between a substantially horizontal seating position and a substantially vertical stacking position;

wherein the torsional energy unit comprises a pair of connection devices connected to the base, each connection device biasing the back to the forward position and limiting angular rotation of the seat between the substantially horizontal seating position and the substantially vertical stacking position.

2. The seating unit of claim 1, wherein:

each connection device allows sides of the back to rotate independently, thereby allowing a first side or a second side of the back to be rotated rearward relative to the other side of the back.

3. The seating unit of claim 1, wherein:

the base includes a yoke having a first side and a second side, the first side having a first one of the connection devices connected thereto and the second side having a second one of the connection devices connected thereto.

4. A seating unit comprising:

a base configured to be positioned on a floor;

a torsional energy unit connected to the base;

a back connected to the torsional energy unit; and a seat rotatably connected to the torsional energy unit;

the torsional energy unit biasing the back to a forward position; and the torsional energy unit limiting angular rotation of the seat between a substantially horizontal seating position and a substantially vertical stacking position;

wherein the torsional energy unit comprises a pair of connection devices connected to the base, each connection device biasing the back to the forward position and limiting angular rotation of the seat between the substantially horizontal seating position and the substantially vertical stacking position; and wherein the connection devices each include a torsional spring biasing the back to the forward position.

5. A seating unit comprising:

a base configured to be positioned on a floor;

a torsional energy unit connected to the base;

a back connected to the torsional energy unit; and a seat rotatably connected to the torsional energy unit;

the torsional energy unit biasing the back to a forward position; and the torsional energy unit limiting angular rotation of the seat between a substantially horizontal seating position and a substantially vertical stacking position;

wherein the torsional energy unit comprises a pair of connection devices connected to the base, each connection device biasing the back to the forward position and limiting angular rotation of the seat between the substantially horizontal seating position and the substantially vertical stacking position; and wherein the seat includes a pivoting member connected at ends thereof to the connection members, the pivoting member including end members having a flange;

wherein the connection devices each include at least one slot accepting the flange; and wherein the flange engages a first end of the at least one slot when the seat is in the vertical stacking position and engaging a second end of the at least one slot when the seat is in the horizontal seating position, thereby limiting angular rotation of the seat between the substantially horizontal seating position and the substantially vertical stacking position.

6. The seating unit of claim 5, wherein:

the pivoting member is not centered about an axis of rotation of the end members.

7. The seating unit of claim 1, wherein:

the base includes casters on a bottom thereof.

8. The seating unit of claim 1, wherein:

the seat and the back are not directly connected.

9. A seating unit comprising:

a base configured to be positioned on a floor;

a pair of connection devices connected to the base;

a back connected to the connection devices; and a seat rotatably connected to the connection devices;

the connection devices biasing the back to a forward position;

the connection devices limiting angular rotation of the seat between a substantially horizontal seating position and a substantially vertical stacking position; and each connection device allowing sides of the back to rotate independently, thereby allowing a first side or a second side of the back to be rotated rearward relative to the other side of the back.

10. The seating unit of claim 9, wherein:

the base includes a yoke having a first side and a second side, the first side having a first one of the connection devices connected thereto and the second side having a second one of the connection devices connected thereto.

11. The seating unit of claim 9, wherein:

the connection devices each include a torsional spring biasing the back to the forward position.

12. The seating unit of claim 9, wherein:

the seat includes a pivoting member connected at ends thereof to the connection members, the pivoting member including end members having a flange;

the connection devices each include at least one slot accepting the flange; and the flange engages a first end of the at least one slot when the seat is in the vertical stacking position and engaging a second end of the at least one slot when the seat is in the horizontal seating position, thereby limiting angular rotation of the seat between the substantially horizontal seating position and the substantially vertical stacking position.

13. The seating unit of claim 12, wherein:

the pivoting member is not centered about an axis of rotation of the end members.

14. A torsional energy unit for a seating unit having a base, a seat and a back, the torsional energy unit comprising:

a base member configured to be connected to the base of the seating unit, the base member including at least one arcuate slot and a notch;

a torsional spring engaged with the base member and having an end;

a pin engaged with the end of the torsional spring and located within the notch of the base member, thereby limiting movement of the end of the torsional spring; and a rotating member rotatably connected to the base member and connected to the pin, the rotating member being configured to be connected to the back of the seating unit; and the torsional spring biasing the rotating member such that the pin will abut a first end of the notch and bias the back to a forward position when the rotating member is connected to the back;

the pin abutting a second end of the notch when the rotating member is connected to the back and the back is forced rearward against the bias of the torsional spring to prevent further rearward movement of the back; and the at least one arcuate slot being configured to accept a flange of the seat of the seating unit therein for limiting movement of the seat.

15. The torsional energy unit of claim 14, wherein:

the base member includes an opening; and the rotating member includes at least one hole;

a fastener extends through the opening of the base member and the at least one hole in the rotating member to rotatably connect the rotating member to the base member.

16. The torsional energy unit of claim 15, wherein:

the rotating member is U-shaped having a pair of legs, each leg of the rotating member including the at least one hole, with the legs surrounding the base member.

17. The torsional energy unit of claim 14, wherein:

the base member includes two slots, thereby allowing the base member to be used on either side of a seating unit.

18. A seating unit comprising:

a pair of connection devices configured to be connected to a base;

a back connected to the connection devices; and a seat rotatably connected to the connection devices;

the connection devices biasing the back to a forward position;

the connection devices limiting angular rotation of the seat between a substantially horizontal seating position and a substantially vertical stacking position; and each connection device allowing sides of the back to rotate independently, thereby allowing a first side or a second side of the back to be rotated rearward relative to the other side of the back;

wherein the connection devices each include a torsional spring biasing the back to the forward position.

19. A seating unit comprising:

a pair of connection devices configured to be connected to a base;

a back connected to the connection devices; and a seat rotatably connected to the connection devices;

the connection devices biasing the back to a forward position;

the connection devices limiting angular rotation of the seat between a substantially horizontal seating position and a substantially vertical stacking position;

wherein the seat includes a pivoting member connected at ends thereof to the connection members, the pivoting member including end members having a flange;

wherein the connection devices each include at least one slot accepting the flange; and wherein the flange engages a first end of the at least one slot when the seat is in the vertical stacking position and engaging a second end of the at least one slot when the seat is in the horizontal seating position, thereby limiting angular rotation of the seat between the substantially horizontal seating position and the substantially vertical stacking position.

* * * * *